United States Patent [19]

Buddrus et al.

[11] Patent Number: 4,934,965

[45] Date of Patent: Jun. 19, 1990

[54] ELECTRICAL CONNECTOR WITH A SPRING CAGE RECEPTACLE

[75] Inventors: Hartmut Buddrus, Wuppertal; Klaus Enneper, Radevormwald, both of Fed. Rep. of Germany

[73] Assignee: Kabelwerke Reinshagen GmbH, Fed. Rep. of Germany

[21] Appl. No.: 357,178

[22] Filed: May 25, 1989

[30] Foreign Application Priority Data

May 26, 1988 [DE] Fed. Rep. of Germany ..... 3817803

[51] Int. Cl.[5] ..... H01R 13/00

[52] U.S. Cl. ..... 439/845

[58] Field of Search ..... 439/845, 849

[56] References Cited

U.S. PATENT DOCUMENTS 2,701,350 2/1955 Foreng ..... 439/849

4,550,963 11/1985 Moors ..... 439/845

*Primary Examiner*—Joseph H. McGlynn

*Attorney, Agent, or Firm*—Reising, Ethington, Barnard, Perry & Milton

[57] ABSTRACT

An electrical plug connector includes a male component with a blade contact and a female component has a socket with a flat profile. The socket has a rectangular cross-section with narrow and broad sides which are segmented by longitudinal slots into a group of parallel arms which form a cage with contact arms buckled toward the interior of the cage. During coupling action, the crests of the buckles of the contact arms come into contact sequentially with the blade edge of the male component.

18 Claims, 5 Drawing Sheets

FIG.13
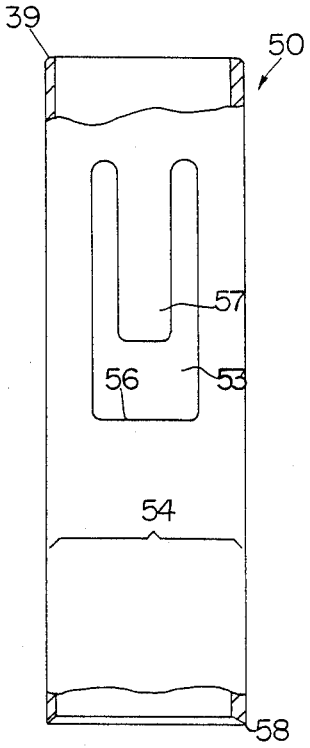
FIG.14
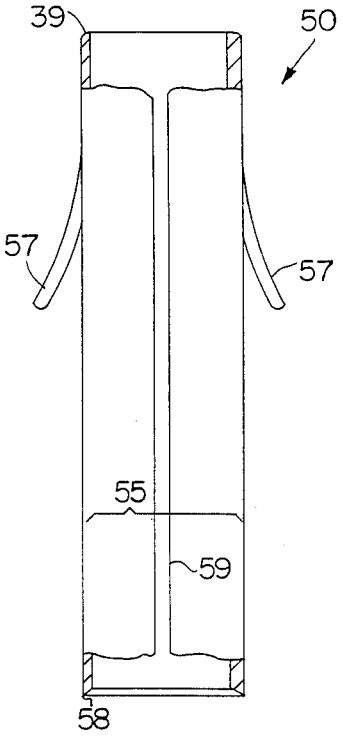
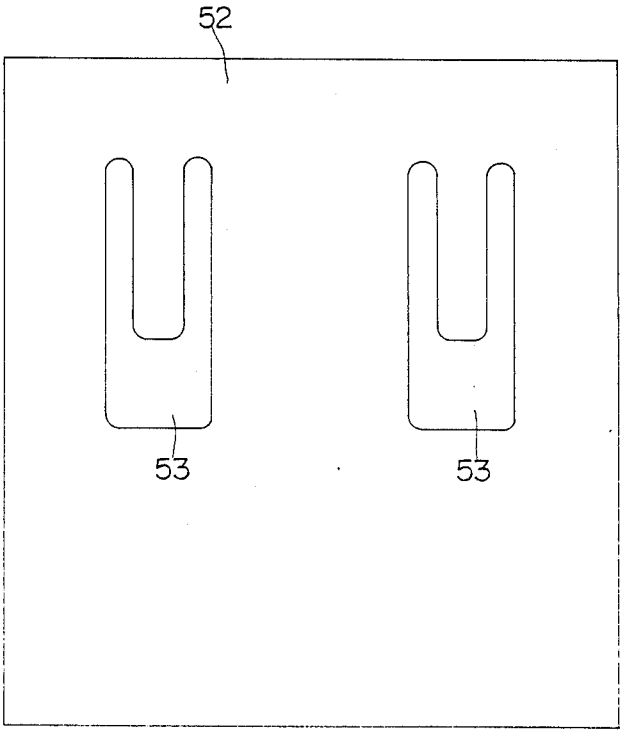
FIG.16
FIG.15
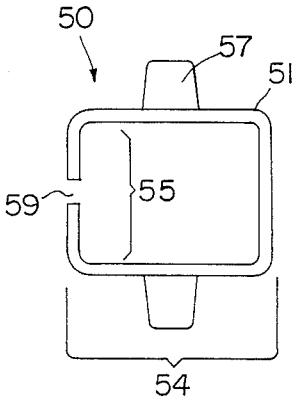

ELECTRICAL CONNECTOR WITH A SPRING CAGE RECEPTACLE

This invention relates to flat plug connectors of the type comprising a male component with a blade contact and a female component with a flat socket having elastic contact points, and wherein, when the components are coupled together, the two narrow sides of the flat socket are turned toward the edges of said blade contact. In the conventional connection (DE-PS 32 44 939). the socket has a C-shaped flat profile, the profiled shank ends of which are tucked in and during coupling are in contact with one of the blade surfaces of the contact on the male component, while the opposite blade surface is spring-loaded by a clasp formed from a C-profile arm which is bent back into the interior of the profile. The C-shanks with longitudinal edges pass over into the C-profile arm connected to them and form a reception canal containing the clip, which touches the blade contact only here and there. Thus, the areas of the C-shanks located on the narrow sides of the flat profile do not come into contact with the blade edges of the male component. In an effort to improve contact, considerable spring-loading of the clip was tried which, however, had the disadvantage of requiring considerable insertion force with the female component during coupling of the blade contact.

The object of this invention is to develop a flat plug connector of the type mentioned, which would save space by virtue of its blade contact and which, on the one hand, makes good contact and, on the other hand, requires little force for coupling. The invention has made it possible to harmonize these two apparently contradictory requirements for good contact and little required force and is distinguished by the following characteristics.

In accordance with the invention, the socket is formed as a rectangular tube with contact arms which result from longitudinal slots in all sides of the tube including both broad and narrow sides. The contact arms on the narrow sides, during coupling, come into contact with the blade edges of the male component. The socket is, thus, formed like a cage on all sides and the contact arms of the cage are provided with buckles or bulges in a V-shape or W-shape. The buckle crests formed thereby spring from all sides against the blade contact in the interior of the cage. A series of contact points are distributed around the blade contact, which taken together produce a large contact surface. Each buckled contact arm, because of its V or W shape, is subjected to spring-loading which is sufficient to make good contact with the blade contact: Surprisingly little force is required to accomplish the coupling because of the very slender, long arm shape of the deformation. During coupling the buckle evens out in the contact arm and makes contact with its crest. Coupling is, thereby, easy, and a good electrical connection is obtained, even for large electrical currents Especially advantageous is a single buckle in each contact arm, which produces a V-shaped arm or V-buckle.

There are, in fact, flat plug connectors of another type (DE-PS 35 02 633), whereby the socket is formed as a completely rectangular tube, but the latter has no cage structure. Several pairs of spring arms are formed along the broad sides which incline toward each other, upon which a pair of reinforcing springs press, which correspondingly form a part of a reinforcement sleeve which is to be slid over the socket.

Finally, with a round plug connection (DE-OS 3625384) it is conventional to arrange an inner sleeve segmented by longitudinal slits into laminations in a pin formation shaped as a massive round tube, which is introduced as a male component into the interior of a socket, constructed as a double-ply, completely round tube, which at the same time has an axial contact pin. The contact pin during coupling produces a limited longitudinal displacement of the longitudinal slit interior sleeve and provides an initial current path, while a second current path originates between the coupled round tubes of the plug and socket. This round plug connection is voluminous.

In accordance with the invention, the crests of the contact arms are longitudinally displaced from each other and not only does a more favorable contact result, but also a reduction in the required insertion force. Because of the longitudinal staggering of their buckles, the contact arms during coupling are not all deformed simultaneously but at intervals. It is advantageous to functional efficiency to form the V shape of the contact arm unsymmetrically. It suffices—while simplifying manufacture and tool usage—to form such unsymmetrically buckled contact arms from two identically formed groups alternating in the rectangular tube cage. The contact arms located on the narrow sides of the cage can be formed symmetrically and are deformed, during coupling, in the time interval between the remaining contact arms. The female component can be constructed as a single part in the simplest embodiment.

To enhance sturdiness and improve manufacture, it is to construct the socket as a rectangular tube cage and to insert it in a box-shaped case which, as an additional segment of the female component, forms a base to which the conductor is connected. A protective sleeve can be provided to envelop the cage and case and it may serve to hold an insulation housing in place with clamps. With this construction using metal sheet material for the female component it is possible to construct each of the segments from the most advantageous material. Each of the cage, case and protective sleeve is formed of metal sheet as rectangular tubes with free edges confronting each other in a butt joint. The butt joints in the case and the protective sleeve are located along different sides of the rectangular tubes. The narrow side is most suitable in the protective sleeve, because the clips for the insulation housing can best be positioned on the broad side.

The segments mentioned should be attached to each other through locking elements, such as elevations which snap into each other or depressions or stop-shoulders. To further secure the assembly, however, welds can be employed, which are preferably laser welds. The best location for the welds is the butt joint to avoid interfering protrusions. Welds in a closed ring profile in the rectangular tube improve its sturdiness. A feed cone can be provided at the front end of the rectangular tube cage which coacts with the case of the base as a stopping lug. Sturdiness can also be increased without welding if the butt joint of metal sheeting folded into a rectangular tube extends labyrinth-like between two adjoining rectangular sides, whereby alternately intertwined fingers traversing the rectangular corner, are provided in the wall of the tube.

DESCRIPTION OF THE DRAWINGS

FIGS. 13 and 14 show a top and side view of the outermost member of the second embodiment;

FIG. 15 shows a frontal view of the member of FIGS. 13 and 14;

FIG. 16 shows a projection of the member of FIGS. 13 and 14; and

Figure 1:
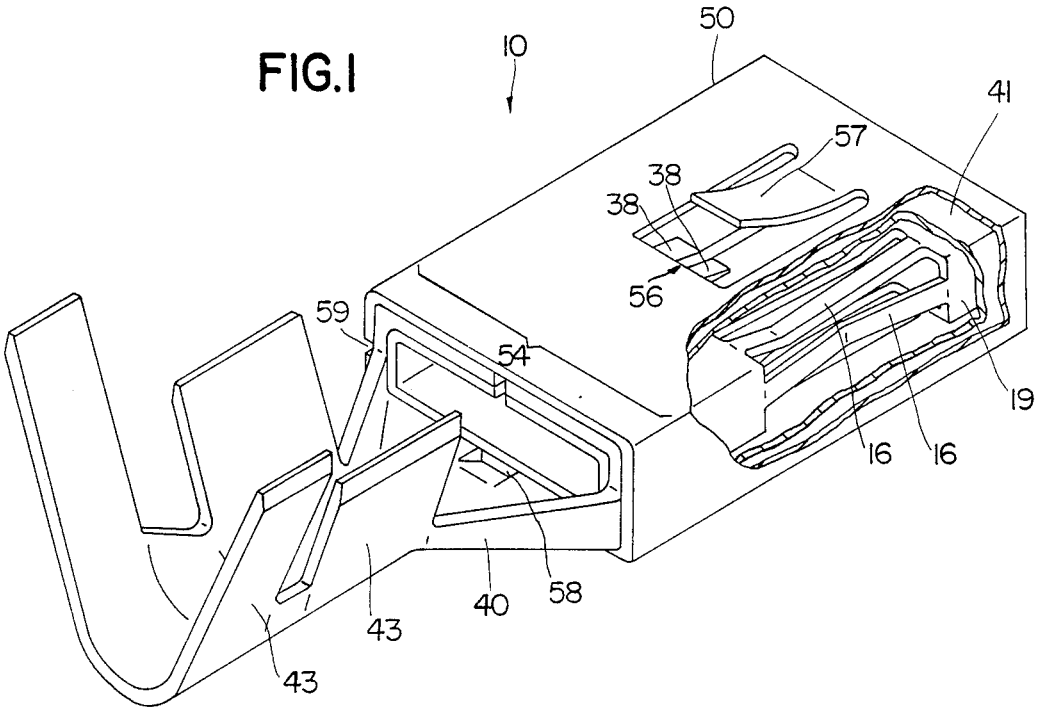
FIG. 1 shows a first embodiment of the invention in the female component of an electrical connector.

In the drawings, only the metal conducting core of the female component 10 of a flat plug connector, according to the invention, is shown, to which an insulation housing belongs, which has not been illustrated. Regarding the complementary male component 20 of the flat plug connector, FIG. 17 also only shows the contact to be attached to an appropriate conductor without the insulation housing. The contact is comprised of a flat blade 21 with a rectangular profile, for which reason it is simply referred to as "blade contact 20". In addition to blade 21, the blade contact 20 is comprised of a single-piece, conventional connection part 22 for a conductor, not shown. The part 22 includes conductor wire claws 23 and conductor insulation claws 24. The blade 21 has upper and lower blade surfaces 25 which are connected together along folded edges, referred to as "blade edges 26". The point 27 of blade 21 has been sharpened to enhance insertion. The entire blade contact is designed as a shaped part of metal sheet, the blade 21 of which is made by folding the metal sheet into a two-ply structure which is pressed together.

Figures 2, 17:
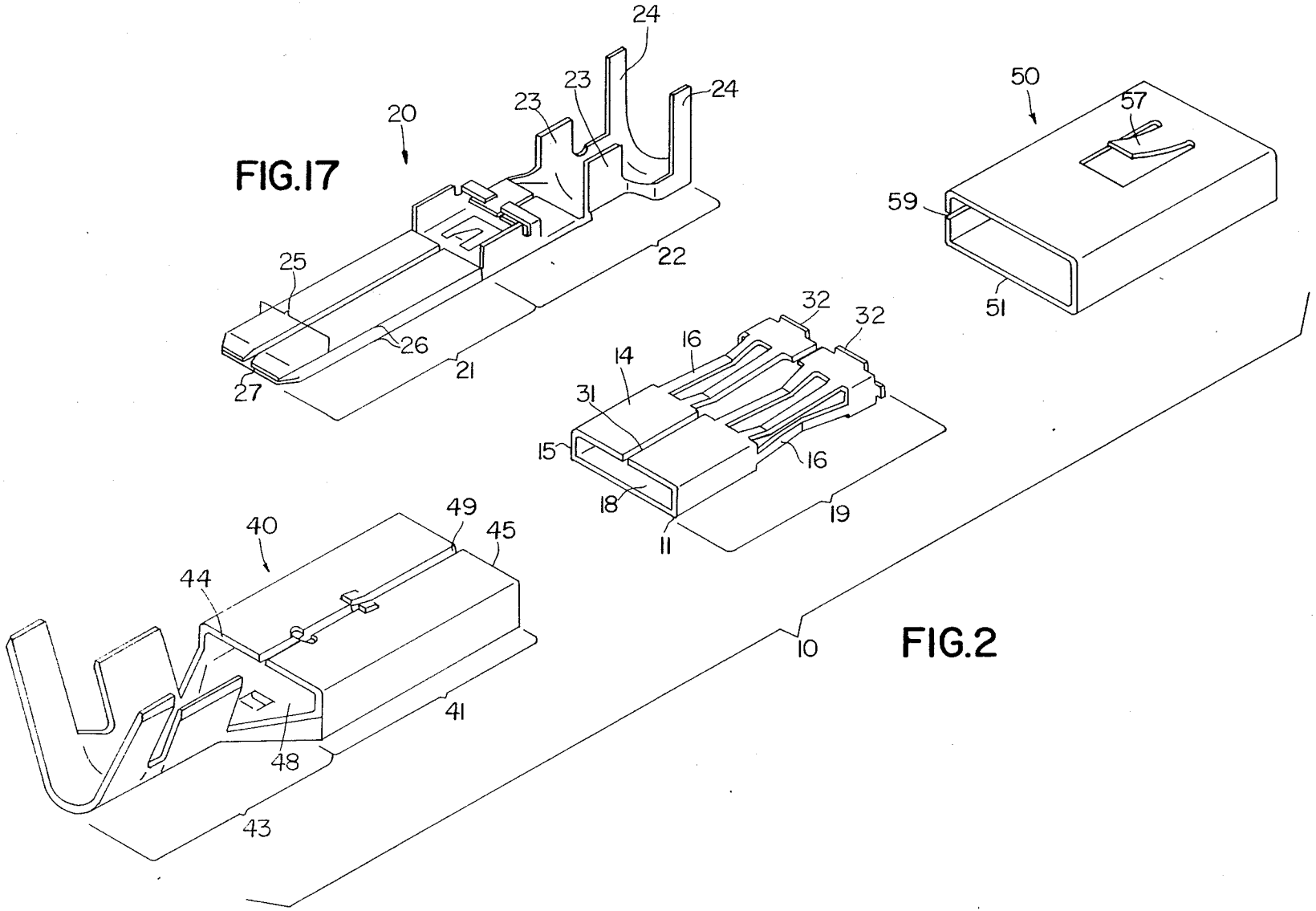
FIG. 2 shows in an exploded view the members of the connector shown in FIG. 1.
FIG. 17 shows a view in perspective of the contact blade of the male component for the female component of FIG. 2.
Figure 4:
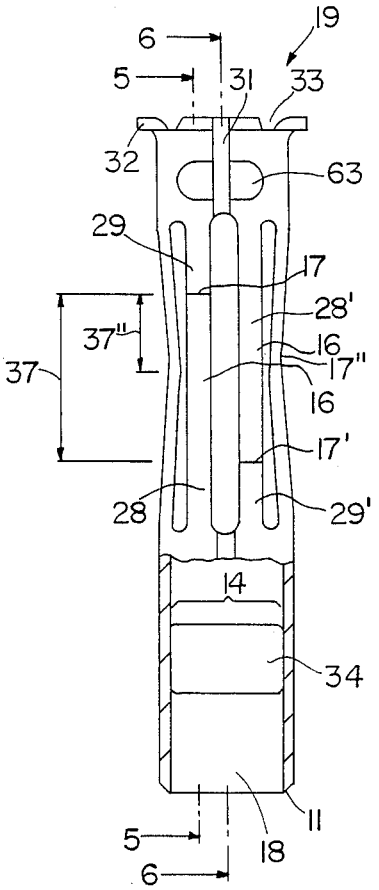
FIG. 4 shows a top view, partially cut away, of the innermost member of the female component of a second embodiment.
Figure 5:
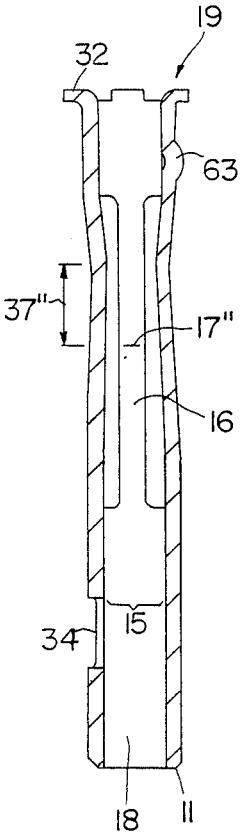
FIGS. 5 and 6 show a cross section of a member of FIG. 4 along lines V—V and VI—VI.
Figure 6:
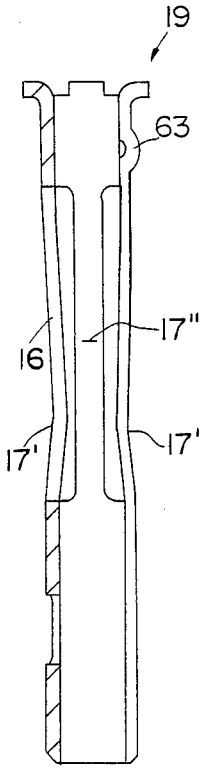

The female component 10 shown in FIG. 1 includes three members, shown in FIG. 2. The construction is shown in detail in FIGS. 4 to 8 for the first member, FIGS. 9 to 12 for the second member and FIGS. 13 to 16 for the third member.

Figure 7:
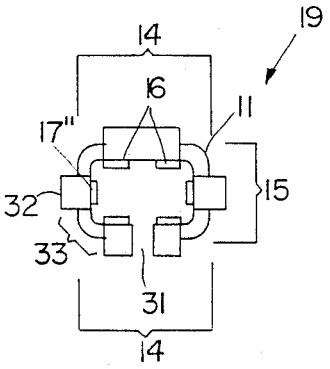
FIG. 7 shows a frontal view of the member of FIG. 4.
Figure 8:
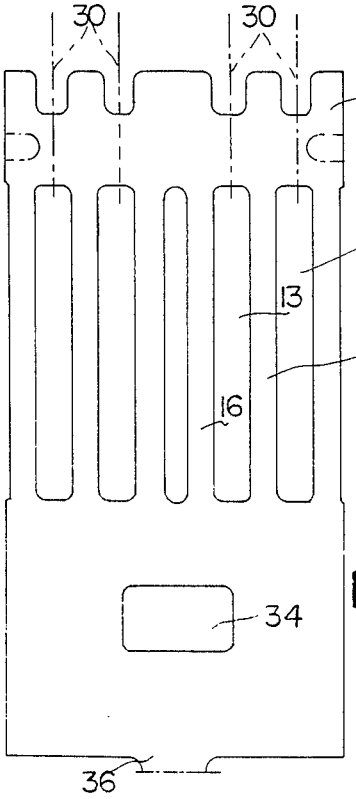
FIG. 8 shows the flat metal sheet from which the member of FIG. 4 is formed.
Figure 12:
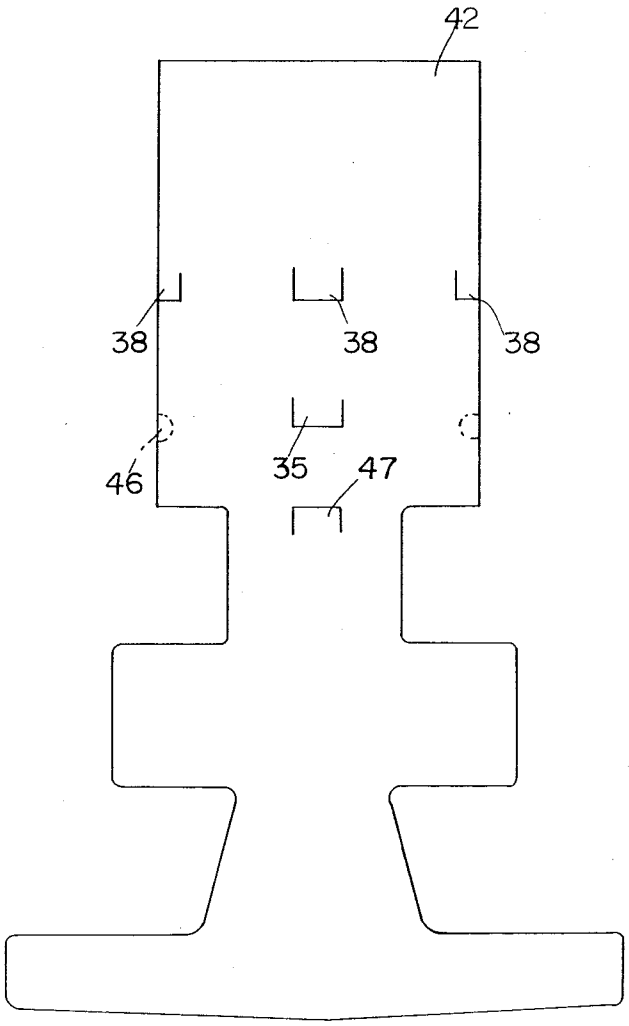
FIG. 12 shows the flat metal sheet from which the member of FIG. 9 is formed.
Figure 11:
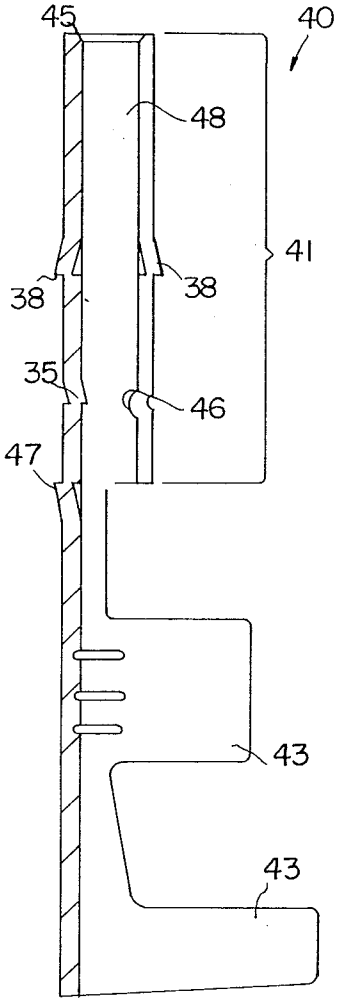
FIG. 11 shows a cross-sectional view along lines XI—XI of FIG. 9.
Figure 10:
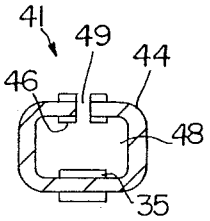
FIG. 10 shows a cross-sectional view along lines X—X of FIG. 9.
Figure 9:
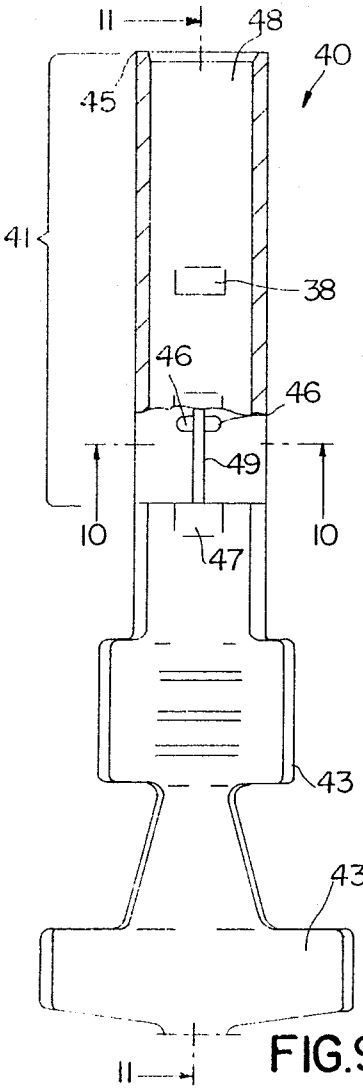
FIG. 9 shows, partially cut away top view of an intermediate member of the female component of the second embodiment.

The innermost member of the female component 10 consists of a socket shaped as a rectangular tube 11 to accept the previously mentioned blade 21 of the male component 20. As shown in FIG. 7, the tube 11 has a rectangular cross-section. It is formed by bending a flat piece of metal sheet 12, as shown in FIG. 8, with punched longitudinal slots 13. The rectangular tube 11 has two broad sides 14 and two narrow sides 15. The longitudinal slots 13 extend over a considerable length of the rectangular tube and leave plural longitudinal, parallel arms 16, each of which have a transverse V-shaped bend or V-buckle crest 17, 17' or 17''. Thus, each arm 16 has a V-shaped longitudinal cross-section with the V-buckle pointing into the interior 18 of the rectangular tube 11. Thereby, contact arms 16 surround the blade 21 of the coupled male component 20 and contact it on all sides. The rectangular tube 11 takes on the appearance of a cage 19, with which, in accordance with the width of the blade 21, several contact arms 16 contact each blade surface 25, namely, two in the embodiment of FIG. 7 and four in the embodiment of FIG. 2. However, during coupling only the V-buckle crest 17'' of a single contact arm engages each blade edge 26. The V-buckle crests 17 are positioned opposite each other and the V-buckle crests 17' are positioned opposite each other as shown in FIGS. 4 to 7.

Two groups of contact arms 16 are located along the broad sides 14 of the cage 19, and have longitudinally offset or eccentrically positioned V-buckle crests 17, 17, but the V-buckle crests 17 are disposed opposite each other in the opposed arms 16 and the same is true of V-buckle crests 17'. The offset of V-buckles 17 result a pair of long and a short V-shanks 28 and 29 in one arm 16 and 28' and 29 in another arm 16. However, the pairs alternate in adjacent contact arms, as shown in FIG. 2. The contact arm 16 located along the narrow side 15 of the cage 19 has V-buckle crest 17'' located at the longitudinal mid-section and both V-shanks are of equal length. As a result, the contact arms 16 are provided with V-buckle crests 17 and 17' which are longitudinally spaced by a distance 37 and V-buckle crests 17' which are midway therebetween and spaced therefrom by a distance 37''. During coupling (i.e., the insertion of the blade 21 into the cage 19) the individual contact arms 16 are successively deformed, and only a small insertion force is required in each instance and at time intervals. The arms 16 have such considerable length and so little width and such a flat buckle that, in any event, only a relatively small deformation force is necessary. When metal sheet 12 is formed into the rectangular tube 11 the free edges are brought into confronting relationship on the broad side 14 in a butt joint 31. The position of the corners to be formed in the metal sheet 12 is indicated in FIG. 8 by dot-dash lines 30. At the extreme end of the cage 19, a cone-shaped flange 32 is located, which is interrupted by cutout sections 33 to facilitate bending. The flange serves as a stopping lug for the segment 40 of the female component 10. A locking slot 34 in one of the broad sides 14 also serves to lock the cage 19 to the segment 40.

The intermediate member consists of a dual-element base 40, which, according to FIG. 2 as well as FIGS. 9 to 12, is formed from metal sheet 42 as a single piece with a box-shaped case 41 at one end and, at the other end, a conventional connection area 43 for a conductor. The box-shaped case 41 has a rectangular cross-section 44, evident in FIG. 10, which is of such dimensions that it will receive the cage 19 as an insert during assembly. The cage 19 is slid into the open front end 45 of the base 40, until the previously mentioned cone flange 32 engages the case 41. The closed broad side of the case 41 is provided with a locking tab 35, which during assembly functions together with the already mentioned locking slot 34 of the cage 19, while a bead 46 is formed on the opposite broad side interrupted by a butt joint 49 during the forming of the box, which facilitates the engagement of the previously mentioned locking members 34, 35. In contrast to the alignment of items in FIG. 2, care could be taken to position the butt joints 31, 49 of both sides along opposite sides of the respective rectangular profile.

The securement of cage 19 to the member 40 can be accomplished alternatively or supplementally by welds, which can be done in the area of butt joints 49 and 31. Reinforcement by the welds is increased if they extend over a large joint length in a closed rectangular configuration. The case 41 is provided on its external broad side with projecting locking hooks 47, 38, which serve to position and secure a third member 50 of the female component 10, as shown in FIGS. 13 to 16.

The outermost member comprises of a protective sleeve 50, which has a rectangular profile 51, evident in FIG. 15. It is made of a material with considerable sturdiness, such as sheet steel 52, which during the first phase of its shaping is the metal sheet evident in FIG. 16. The latter is connected, like the remaining metal pieces 12 and 42 of FIGS. 8 to 12, during formation, of course, through an insert 36, indicated in FIG. 8, to the remaining metal sheet in strip form, which is moved from station to station. The metal sheeting material 12 of the rectangular tube cage 19 is of a different type and consists of a material with considerable elasticity, adequate for the elastic properties of the contact arm 16. The metal sheeting 42 of the base 40, on the other hand, consists of a material with especially good conductivity, for which reason a greater copper content is desirable in the metal alloy.

The sheet steel 52 is provided, as shown in FIG. 16 with two windows 53 in which clamps 57 are formed to extend outward as shown in FIG. 15. This will facilitate the subsequent assembly of the insulation housing of the female component 10, already mentioned.

The rectangular profile 51 of the sleeve 50 is formed by folding of the sheet steel 52 along parallel lines, whereby the butt joint 59 is positioned along one of the narrow sides 55, while the previously mentioned windows 53 with clamps 57 are located along both broad sides 54.

The protective sleeve 50 has a profile size 51 which can just encase the box-shaped case 41 of the base 40. The previously mentioned locking hooks 47 and 38 on case 41 serve reciprocally to secure the position of these two members. The inner locking hook 47 serves as a stop lug engaging for the inner front end 58 of the protective sleeve 50. The outer locking hooks 38, on the other hand, pass into the window 53, located along the broad sides mentioned, and engage the interior edge of the window 56, evident in FIG. 13. The length of the protective sleeve 50 is selected to fit the case 41; in particular, once its position has been secured by the locking hooks 38, 47, the above-mentioned front end 45 together with the cone flange 32 of the inserted cage 19 lies flush with the outer front end 39 of the protective sleeve. The respective positions of the protective sleeve 50 and the base 40 can be alternatively or additionally secured through welds, in particular laser welds. The welds are expediently made in the butt joint 59 in a closed ring-shaped rectangular profile 51.

Of course, other locking devices, in addition to the ones mentioned here, can be used to secure the mountings. Tubes 11, 41, 50 stacked together in contact with the surface can be provided with aligned openings, which may be engaged by elevations in a locking action. For example, this holds true for the female component 10″, shown in FIG. 3, where instead of the prescribed clamp 57 for locking the relevant female housing, the protective sleeve 50″ located there has a completely cutout window 53″, which during assembly is aligned with an aperture 60 in the broad side wall of the case 41″ of the appropriate base. After assembly of the insulation housing, a locking protrusion engages the window 53″ and the aperture 60 and thereby secures the position of these parts in the female component 10″ and locks the female component to the insulation housing.

Figure 3:
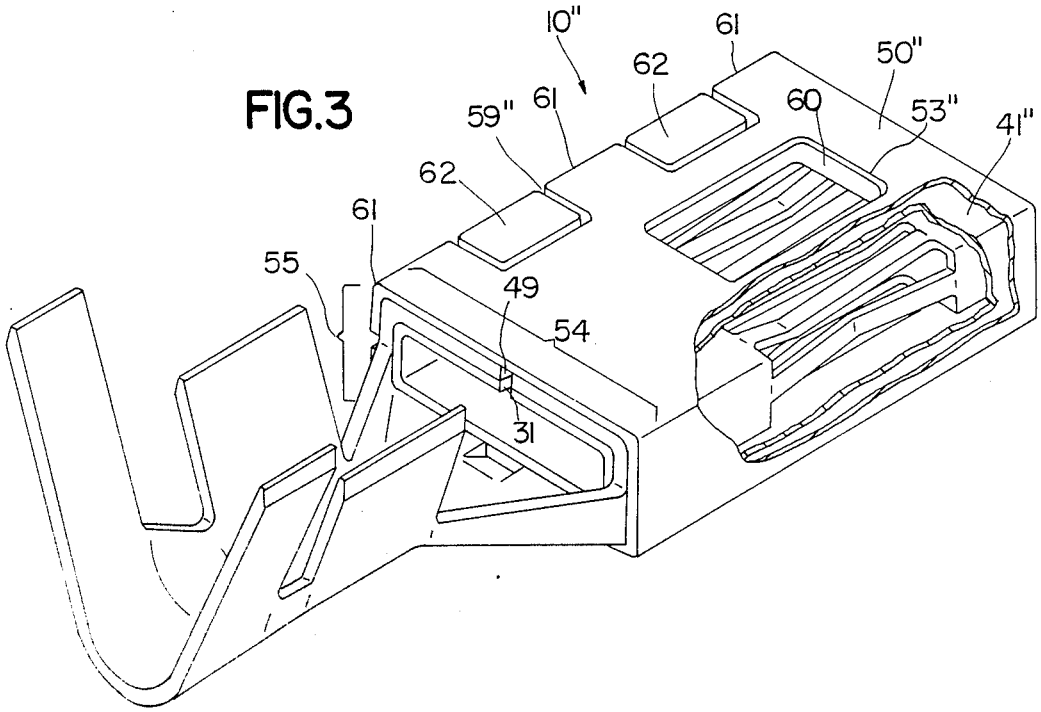
FIG. 3 shows a modification.

A further characteristic of FIG. 3 is that in the protective sleeve 50″ the butt joint 59″ runs a labyrinth-like course and thereby extends across the broad side 54 as well as across the narrow side 55. By virtue of this scalloped labyrinth-like course, alternatinqly intertwined upper and lower fingers 61, 62 originate which extend from one side 54 to the other 55 or the reverse. Thereby, the rectangular profile of the protective sleeve 50″ is rendered more solid, and the assembly of the remaining segments of the female component 10″ is improved.

The embodiment of the female component shown in FIG. 1 is, in general, the same as the embodiment, described in FIGS. 4 to 16. They differ only in the dimensioning of profile widths; the rectangular profile shown in FIGS. 1 and 2 has a larger broad side 54 and therefore belongs to a flat plug connector of another size, which has a blade contact with correspondingly broader blade surfaces 25. Accordingly, a larger number of contact arms 16 is possible, as already described. The cage 19, according to FIGS. 4 to 6, having a butt joint 31 along its broad side 14, can be provided with a protrusion 63, the peak of which interacts during assembly with the interior wall surface of the case 41 of the base 40. In the embodiments of FIGS. 1 to 3, the butt joints 31, 49 of the cage 19 and the case 41 are also aligned with each other, which is advantageous to the welding mentioned, for example, laser welding.

What is claimed is:

1. In an electrical plug connector of the type comprising a female component including a flat rectangular socket with two wide side walls and two narrow side walls and a male component including a blade contact adapted to be inserted into and withdrawn from said socket with the lateral edges of the blade contact disposed opposite the two narrow side walls of said socket, said socket including contact points for engaging said blade contact, the improvement wherein:

one narrow side wall and one wide side wall of said socket has an inwardly extending contact element unitary with the respective wall for engaging an edge and a side, respectively, of said blade contact.

2. The invention as defined in claim 1 wherein said inwardly extending contact element is a longitudinally extending segment of said respective side wall, said segment being V-shaped in cross-section.

3. The invention as defined in claim 2 wherein all of said side walls have an inwardly extending contact element unitary with the respective wall.

4. The invention as defined in claim 3 wherein the contact elements of adjacent side wall segments are longitudinally offset from each other.

5. The invention as defined in claim 4 wherein there are at least two side wall segments in each of said wide side walls.

6. The invention as defined in claim 4 wherein the contact elements on the side wall segments on said narrow side walls are longitudinally centered on the respective segment.

7. The invention as defined in claim 2 including a box-shaped case surrounding the four walls of said rectangular socket and connection means on said case for an electrical conductor.

8. The invention as defined in claim 7 wherein said rectangular socket is provided with a stop lug at the front of the socket for engaging the edge of the rectangular case.

9. The invention as defined in claim 7 including a rectangular sleeve surrounding said box-shaped case and means on said sleeve for interlocking it with an insulated housing.

10. The invention as defined in claim 9 wherein said rectangular socket is constructed of sheet metal having elastic properties and said box-shaped case is constructed of sheet metal having good electrical conductivity.

11. The invention as defined in claim 9 wherein each of said rectangular socket, rectangular case, and said rectangular sleeve is constructed of a separate piece of sheet metal with a longitudinally extending butt joint, said butt joints being disposed in side walls which are not adjoining each other.

12. The invention as defined in claim 11 wherein the butt joint in the sleeve is disposed in a narrow side wall.

13. The invention as defined in claim 11 wherein the confronting edges of said rectangular sleeve are provided with spaced fingers extending transversely of the sleeve, said fingers of one edge being interdigitated with the fingers of the other edge and extend into two side walls of said sleeve.

14. The invention as defined in claim 9 wherein said rectangular socket and said box-shaped case are longitudinally interlocked with each other by first locking means and said box-shaped case and said rectangular sleeve are interlocked with each other by second locking means.

15. The invention as defined in claim 14 wherein said locking means comprises a window in one side wall and a locking hook in the adjacent side wall.

16. The invention as defined in claim 14 wherein one of said locking means comprises a laser weld.

17. The invention as defined in claim 16 wherein the laser weld is located adjacent a butt joint.

18. The invention as defined in claim 17 wherein a weld between said sleeve and said case extends in a closed ring-shaped rectangular configuration.

* * * * *